United States Patent [19]

Jackson

[11] 4,228,949

[45] Oct. 21, 1980

[54] SOLID BOWL SCROLL DISCHARGE DECANTER CENTRIFUGES

[75] Inventor: Joseph F. Jackson, Huddersfield, England

[73] Assignee: Thomas Broadbent & Sons Limited, Huddersfield, England

[21] Appl. No.: 948,274

[22] Filed: Oct. 3, 1978

[30] Foreign Application Priority Data

Oct. 4, 1977 [GB] United Kingdom ..... 41143/77

[51] Int. Cl.[2] ..... B04B 1/20; B04B 9/10; B04B 11/04

[52] U.S. Cl. ..... 233/7; 233/19 R; 233/24

[58] Field of Search ..... 233/24, 23 R, 7, 46, 233/19 R, 19 A

[56] References Cited

U.S. PATENT DOCUMENTS

| | | | |
|---|---|---|---|
| 3,734,399 | 5/1973 | Oas | 233/19 A |
| 3,923,241 | 12/1975 | Cyphelly | 233/7 |
| 4,085,888 | 4/1978 | Jager | 233/24 |
| 4,113,171 | 9/1978 | Cyphelly | 233/24 |

FOREIGN PATENT DOCUMENTS

| | | | |
|---|---|---|---|
| 429850 | 1/1975 | U.S.S.R. | 233/19 R |

*Primary Examiner*—George H. Krizmanich

*Attorney, Agent, or Firm*—Beveridge, DeGrandi, Kline & Lunsford

[57] ABSTRACT

A solid bowl decanter centrifuge comprising a solid, generally cylindrical bowl having a liquids outlet at one end and a solids outlet at the other end. A drive for rotating the bowl at a first speed. Inlet pipework for introducing influent to the interior of the bowl and a feed valve in the inlet pipework for controlling the rate of flow of influent therethrough. A scroll conveyor mounted for rotation within the bowl at a second speed. A hydraulic motor whose body is connected to the bowl and whose output shaft is connected to the scroll conveyor whereby the motor speed determines the differential speed of the conveyor relative to the bowl. The hydraulic motor has a hydraulic drive system which includes a pump for supplying hydraulic fluid to the motor. A primary control system is adapted to monitor the hydraulic pressure in the hydraulic drive system for the hydraulic motor and to regulate in a known manner the displacement of the pump so as to maintain a predetermined relationship between conveyor speed and the pressure in the hydraulic drive and hence between the conveyor speed and the conveying torque. A secondary control system responds to the flow rate in the hydraulic drive of the motor to control the feed valve opening state such as to maintain the flow rate in the hydraulic drive, and hence the conveyor speed and the rate of discharge of solid material, at a substantially constant predetermined value.

7 Claims, 6 Drawing Figures

Figure 2A:
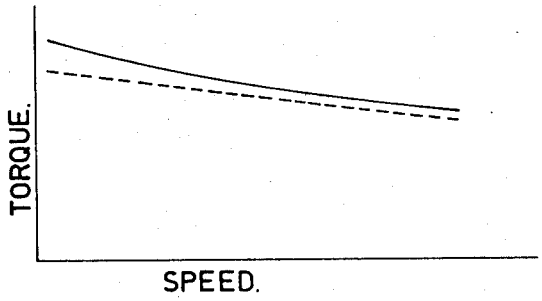

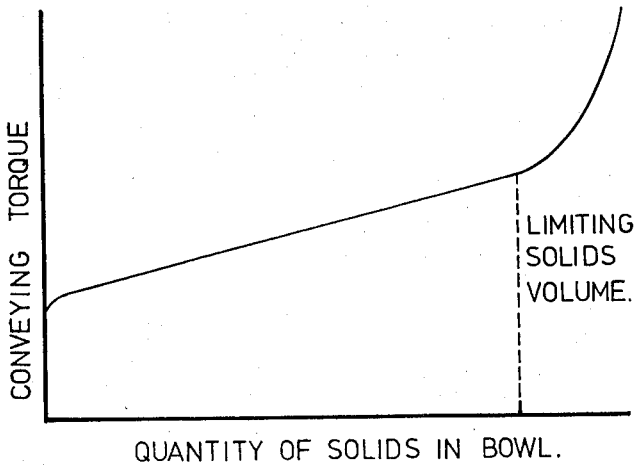
—F I G.1.—

SOLID BOWL SCROLL DISCHARGE DECANTER CENTRIFUGES

DESCRIPTION

The present invention relates to solid bowl decanter centrifuges of the scroll discharge type.

Solid bowl decanter centrifuges frequently have to operate in conditions in which the solids concentration of the input feed suspension to the centrifuge varies. Where the solids constitute the end product and centrifugal separation preceeds a subsequent thermal drying process, it is often desirable to maintain a constant solids discharge rate to achieve uniform thermal loading of the dryer. It is known to carry this out automatically by a control arrangement in which the admission of the feed suspension rate is regulated in response to changes in solids concentration. However, the known methods of performing this technique have involved the accurate direct continuous measurement of suspended solids content of the feed suspension. This has been accomplished by the measurement of relative densities which is an extremely difficult task, particularly in processes involving centrifugal separation where the relative density difference between the solids and suspending liquid is small.

A further problem also occurs due to the relatively slow response of the known control arrangement. This is associated with the delay occurring between a change in feed valve opening and the output response in terms of the quantity of solids within the centrifuge bowl. This makes it difficult to operate the centrifuge just below its limiting solids capacity to achieve maximum cake dryness without plugging occurring.

The primary object of the present invention is to provide a means of achieving a constant solids discharge rate in a scroll discharge type decanter centrifuge without recourse to direct measurement of solids concentrations.

In accordance with the present invention, there is provided a solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a feed valve in said inlet pipework for controlling the rate of flow of influent therethrough, a scroll conveyor mounted for rotation within the bowl at a second speed, a hydraulic motor whose body is connected to the bowl and whose output shaft is connected to the scroll conveyor whereby the motor speed determines the differential speed of the conveyor relative to the bowl, a hydraulic drive system for the hydraulic motor which includes a pump for supplying hydraulic fluid to the motor, a primary control system adapted to monitor the hydraulic pressure in the hydraulic drive system for the hydraulic motor and to regulate the displacement of the pump so as to maintain a predetermined relationship between conveyor speed and the pressure in the hydraulic drive and hence between the conveyor speed and the conveying torque, and a secondary control system which is adapted to respond to the flow rate in the hydraulic drive of the motor to control the feed valve opening state such as to maintain the flow rate in the hydraulic drive, and hence the conveyor speed and the rate of discharge of solid material, at a substantially constant predetermined value.

Conveniently, the secondary control system includes a valve having a control slide whose position is determined by the pressure drop across a restrictor in a hydraulic line connected to the motor, preferably in the hydraulic fluid supply line, the position of the control slide varying the supply of pressurised fluid to the differential piston of a power cylinder controlling the opening state of the feed valve.

The system in accordance with the present invention, with its primary control loop controlling the differential speed of the conveyor and its secondary control loop controlling the feed valve, has several beneficial advantages compared with the known systems referred to initially, namely a faster response to variations of solids discharge whereby such variations in the rate of discharge are smaller in magnitude and shorter in duration, the machine is more controllable, and it is possible to accept a wider variation of solids content in the input feed without causing substantial variation in the rate of solids discharge.

Figure 2B:
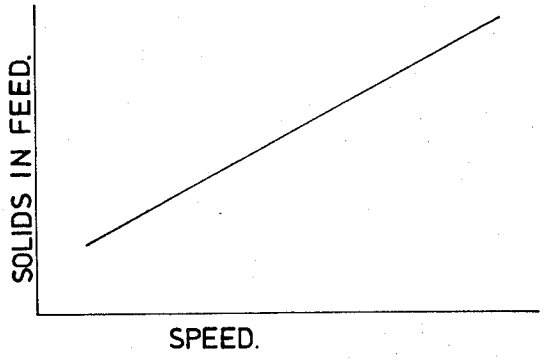
Figure 2C:
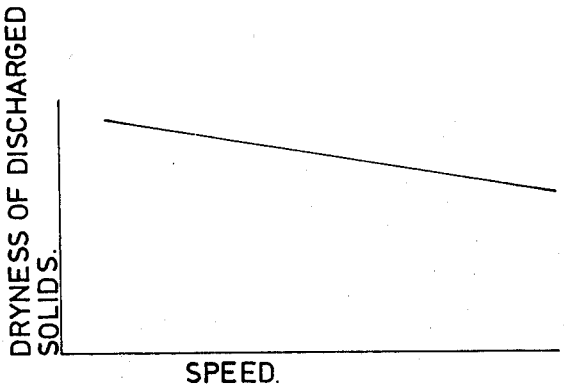
Figure 3:
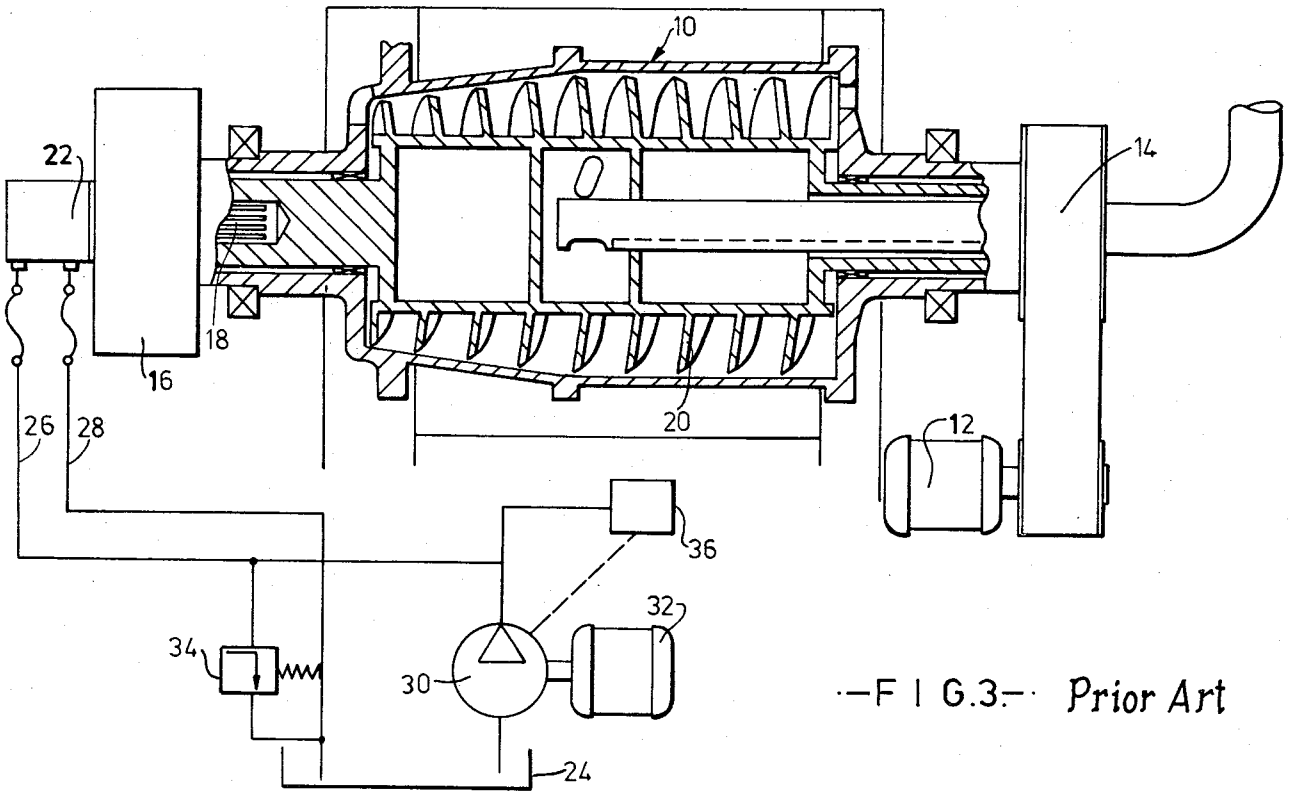
FIG. 3 Prior Art
Figure 4:
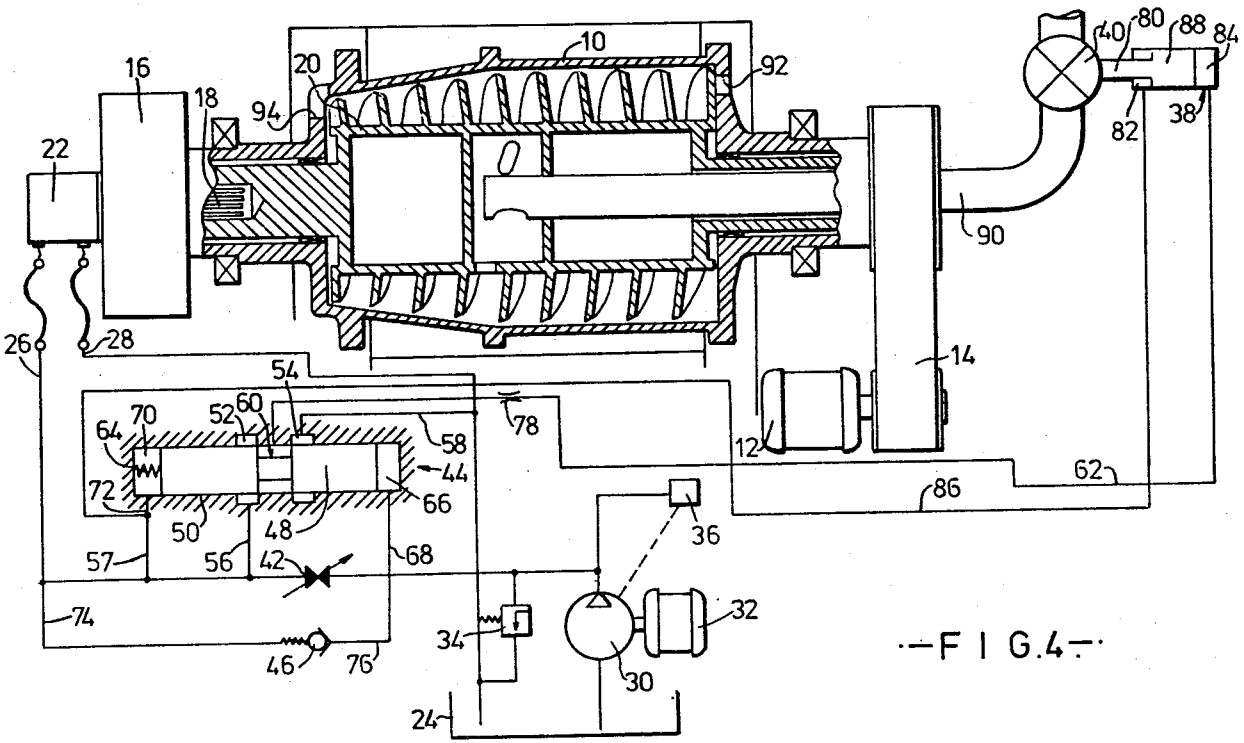

The invention is described further hereinafter, by way of example, with reference to the accompanying drawings, in which:

FIG. 1 is a graph for use in illustrating the operation of a scroll decanter centrifuge and showing conveying torque against quantity of solids in the centrifuge bowl;

FIG. 2*a* is a graph of torque against conveyor differential speed;

FIG. 2*b* is a graph of quantity of solids in the input feed suspension against the conveyor speed;

FIG. 2*c* is a graph of dryness of discharged solids against conveyor speed;

FIG. 3 is a diagrammatic illustration of a scroll decanter centrifuge fitted with a known control system; and FIG. 4 is a diagrammatic illustration of a scroll decanter centrifuge fitted with a control system embodying the invention.

Prior to describing the improved operating system and method in accordance with the present invention, the known method is described in which the differential rotational speed of the conveyor is automatically varied in response to changes in conveying torque requirements to maintain a substantially constant quantity of solids within the centrifuge bowl.

In the operation of decanter centrifuges, the quantity of solids contained within the centrifuge bowl is a function of the influent rate, the differential speed between the bowl and discharge conveyor and the quantity of suspended solids contained in the food suspension. For a given feed rate and conveyor speed, the quantity of solids contained in the bowl depends on the time integral of the quantity of suspended solids in the feed. An increase in suspended solids concentration yields an increasing quantity of solids within the bowl which eventually stabilises to a greater quantity than the initial value. Conversely, if the solids concentration is maintained constant, an increase in conveyor speed promotes a reducing quantity of solids within the bowl which eventually stabilises to a level below the original value.

If the operating conditions of a decanter centrifuge are such that the maximum solids volume within the bowl is utilized then the residence time is maximised and the centrifuge will perform at its optimum setting in terms of solids dryness. However, in the event of an increase in solids concentration of the feed suspension occurring, the solids capacity of the bowl will eventually be exceeded causing the machine to plug and preventing its effective operation. By automatically controlling the conveyor speed to maintain a substantially constant quantity of solids within the bowl even under conditions of varying solids concentration, the centrifuge may be continuously operated at or near to its optimum performance.

For a particular feed material and given centrifuge bowl rotational speed, the conveying torque is approximately proportional to the quantity of solids contained within the centrifuge bowl. Secondary effects modify this relationship somewhat and the dryness of the discharged solids has a minor influence on the torque relationship. However, the actual relationship may be represented in the form illustrated in FIG. 1 in which the abscissa-axis denotes the quantity of solids in the bowl and the ordinate-axis shows the necessary conveying torque. A low finite driving torque is normally required to overcome frictional resistance when the bowl is completely empty of solids. At the other extreme condition, when the limiting solids volume of the bowl is exceeded, a steep increase in torque occurs due to plugging. Between these two extremes, the relationship connecting conveying torque and solids volume within the bowl is substantially linear. This permits the measured conveying torque to be used to automatically control conveyor speed and optimise performance by maintaining an operating condition just within the limiting solids handling capacity, thus maximising solids residence time and dryness of the discharged cake.

The torque/speed relationship obtained by varying the quantity of solids in the feed suspension is illustrated in FIG. *2a* where the abscissa-axis denotes the limiting conveyor differential speed below which plugging will occur and the ordinate-axis indicates the necessary conveying torque corresponding to this speed. FIG. *2b* shows the variation of suspended solids in the feed against speed and FIG. *2c* similarly shows the variation in dryness of the discharge solids, both curves b and c corresponding to the torque speed relationship shown in FIG. *2a*. Referring to these graphical relationships it will be appreciated that a reduction in solids concentration in the feed permits a similar reduction in conveying speed to be made and the increased residence time of solids in the bowl yields an increase in solids dryness with a corresponding small increase in torque level from its original value. This accounts for the slight negative slope of the torque speed characteristic shown in FIG. *2a*.

Control of conveying speed in response to torque entails the provision of an automatic system with a torque/speed characteristic generally of the form shown by the discontinuous line in FIG. *2a* such that the operation of the centrifuge is restricted to just below the limiting condition shown by the continuous line defining its maximum capacity.

Various methods may be employed to drive decanter centrifuge conveyors but a hydraulic drive system utilising a slow speed high torque hydraulic motor conveniently permits a variation in the differential speed while permitting simple measurement of conveying torque. A known system based on this arrangement is represented diagrammatically in FIG. 3 in which the centrifuge bowl 10 is rotated by a separate electric motor 12 through drive belts 14. Connected to and rotating with the bowl 10 is a slow speed hydraulic motor 16 whose output shaft 18 engages with and drives the conveyor 20 at a differential speed.

Pressurised hydraulic fluid is conducted to the motor through a rotating coupling arrangement 22, the low pressure exhausted fluid being conducted from the hydraulic motor 16 back to a reservoir 24. The outer casing of the hydraulic rotary coupling 22 is stationary and connecting pipes 26 and 28 respectively conduct hydraulic fluid from a hydraulic pump 30 and return it to the reservoir 24. The hydraulic pump 30 is driven by a separate electric motor 32 and is protected from overpressure by a conventional pressure relief valve 34. The pump 30 is of the positive variable displacement type and employs a control arrangement 36 which is adapted to automatically regulate the pump displacement from a preset minimum value in response to changes in pressure in the line 26, the latter pressure being proportional to the required conveying torque. The control mechanism 36 is arranged to regulate the speed in response to changes in pressure in the line 26 such as to maintain the preferred relationship between speed and torque illustrated by the discontinuous line shown in FIG. *2a*.

In the system in accordance with the present invention described hereinafter, the known control arrangement described above is used in conjunction with a secondary control system in which the admission of feed suspension is regulated to maintain a constant conveyor speed whereby the dry solids discharge rate may be maintained at a substantially constant value. The function of the primary control corresponding to the known arrangement described above is to obtain a substantially constant quantity of solids within the centrifuge bowl and regulation of the conveyor drive to maintain a fixed differential speed will then result in a substantially constant solids discharge rate. The primary control is arranged to have a relatively fast response so that any sudden changes in feed concentration are prevented from plugging the machine. In the case of the secondary control, regulation of the feed valve is carried out using a slow acting system to maintain stability and prevent the occurrance of hunting. Since the primary control is fast-acting, the decanter may be operated near to its limiting solids handling capacity thus giving maximum cake dryness.

The additional control arrangement to convert the primary system to the improved version giving a constant solids discharge rate is illustrated in FIG. 4. The extra items constituting the secondary control system comprise an actuating cylinder 38 for controlling the opening of the feed valve 40, an adjustable orifice 42 in the conduit 26 feeding the hydraulic motor 16 and a spool type control valve 44 for controlling the actuating cylinder 38. A spring loaded relief valve 46 is included to by-pass the flow through the adjustable orifice 42 in the event of a sudden increase in conveyor speed promoting a high fluid flow rate in conduit 26.

The control valve 44 comprises a valve spool member 48 housed in a close fitting body 50 with annular grooves 52 and 54 connected respectively to the main hydraulic feed line 26 by a conduit 56 and the motor return line 28 by a conduit 58. A reduced diameter portion 60 in the valve spool 48 ensures that when the spool 48 is moved to the left of its central neutral position the conduit 62 leading to the cylinder 38 is pressurised by its connection to conduit 56 and that when moved to the right, it is exhausted to a low pressure by its connection to the return conduit 58. The valve spool 48 is biased by a spring 64 to move to the right as viewed in FIG. 4. In the neutral position, the spring force is exactly balanced by the differential pressure drop across the adjustable orifice 42. The chamber 66 at the end remote from the spring 64 is connected to a point immediately up-stream of the orifice 42 by a connection 68 and the chamber 70 at the opposite end of the spool 48 is similarly connected by conduits 72 and 57 to a point immediately down-stream of the orifice 42.

The relief valve 46 is connected by conduits 74 and 76 across the orifice 42 and serves to by-pass any excess flow in the event of a sudden increase in conveying speed and prevents the excessive build up of differential pressure. The control output from valve 44 is connected by conduit 62 through a restrictor 78 to the full area of the valve actuating cylinder 38. The diameter of the piston rod 80 of the cylinder 38 is selected so that the annular area subjected to pressure in chamber 82 is approximately half the full piston area subjected to pressure in chamber 84. The annular chamber 82 is permanently connected to the main pressure line 26 by conduits 86 and 56. Movement of the piston 88 of cylinder 38 to the left causes the feed valve 40 to close, thus reducing the admission of feed suspension into the centrifuge and conversely a movement to the right promotes an increase in feed rate.

The primary control system described initially maintains a substantially constant quantity of solids within the centrifuge bowl by ensuring that the conveying torque remains constant at a preselected level. To obtain a constant discharge rate of dry solids it is only necessary to ensure that the conveyor differential rotational speed is maintained substantially constant at a desired predetermined value. This control is carried out by the secondary control system.

Considering the secondary system, the flow rate of hydraulic fluid through the orifice 42 is proportional to the rotational speed of the hydraulic motor 16 driving the conveyor 20. If the flow rate is maintained constant then the conveyor differential speed will also remain constant.

Assuming initially that the system is in an equilibrium condition and a sudden increase then occurs in the solids concentration of the feed suspension, the primary control system increases the rotational speed of the conveyor to counter-act the increase in solids within the decanter bowl to maintain a constant conveying torque and to prevent plugging occurring. The increased conveyor speed promotes an increase in the flow rate through the restrictor 42 with a corresponding increase in the pressure differential in chambers 66 and 70 communicating with the ends of the control spool 48.

The increased pressure in chamber 66 compared with the pressure in chamber 70 causes the valve spool 48 to move to the left against the restraining force of the spring 64. Movement of the spool from its neutral position selectively admits pressure to the full area of the actuating cylinder 38 through connecting conduit 62. This causes the feed valve 16 to close, so reducing the rate of admission of feed suspension to the centrifuge until the original selected conveyor rotational speed is attained and the system achieves a condition of equilibrium. Similarly a reduction in the solids concentration of the feed suspension causes the feed valve 40 to open, so increasing the rate of admission of the feed suspension until the predetermined conveyor speed is again attained.

Manual selection of the conveyor speed is achieved by setting the opening of the adjustable orifice 42, an increased opening promoting an increase in conveyor speed with a corresponding increase in discharged solids and conversely a reduction in opening promoting a reduced solids discharge rate.

The control arrangement need not necessarily be constructed exactly as illustrated in FIG. 4. For example, the control valve 44 could be of the five port configuration rather than the three port version shown, with an equal area valve actuating cylinder. Similarly, the actuating cylinder 38 may be replaced by a rotary actuator for controlling the feed valve opening. The positioning of the metering orifice 42 in the return line 28 rather than the pressure line 26 may be alternatively employed when it is not necessary to maintain a low pressure in the return line of the hydraulic motor 16. In a further embodiment, a separate source of hydraulic pressure may be employed to power the actuating cylinder 38. In this case, the conduit 56 is connected to the separate hydraulic pump outlet.

I claim:

1. In a solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a feed valve in said inlet pipework for controlling the rate of flow of influent therethrough, a scroll conveyor mounted for rotation within the bowl at a second speed, a hydraulic motor whose body is connected to the bowl and whose output shaft is connected to the scroll conveyor whereby the motor speed determines the differential speed of the conveyor relative to the bowl, a hydraulic drive system for the hydraulic motor which includes a pump for supplying hydraulic fluid to the motor, and a primary control system adapted to monitor the hydraulic pressure in the hydraulic drive system for the hydraulic motor and to regulate the displacement of the pump so as to maintain a predetermined relationship between conveyor speed and the pressure in the hydraulic drive and hence between the conveyor speed and the conveying torque, the improvement comprising a secondary control system which is adapted to respond to the flow rate in the hydraulic drive of the motor to control the feed valve opening state such as to maintain the flow rate in the hydraulic drive, and hence the conveyor speed and the rate of discharge of solid material, at a substantially constant predetermined value.

2. A centrifuge according to claim 1 wherein the secondary control system includes a control valve having a control slide, a restrictor device disposed in one of the hydraulic lines connected to said motor, and a power cylinder for controlling the opening state of said feed valve, said power cylinder having a differential piston, said control valve being coupled to said one of the hydraulic lines such that the position of said control slide of the control valve is determined by the pressure drop across said restrictor device and said control valve being coupled to said power cylinder to control the variation of the supply of pressurised fluid to said differential piston of the power cylinder for controlling the opening state of said feed valve.

3. A centrifuge according to claim 2 wherein the restrictor is located in the high pressure fluid supply line to the hydraulic motor.

4. A centrifuge according to claim 2 or 3 wherein the restrictor comprises a variable orifice whose size sets the desired conveyor speed.

5. A centrifuge according to claim 3 wherein said control valve controls the supply of pressurized fluid to the power cylinder from a point in said high pressure supply line downstream of the restrictor but upstream of the hydraulic motor.

6. A centrifuge according to claim 3 wherein the power cylinder has a differential area piston whose larger area side is selectably connectable to said high pressure supply line of the motor by the control valve and whose smaller area side is permanently connected to said high pressure supply line.

7. A solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a feed valve in said inlet pipework for controlling the rate of flow of influent therethrough, a scroll conveyor mounted for rotation within the bowl at a second speed, a hydraulic motor whose body is connected to the bowl and whose output shaft is connected to the scroll conveyor whereby the motor speed determines the differential speed of the conveyor relative to the bowl, a hydraulic drive system for the hydraulic motor which includes a pump for supplying hydraulic fluid to the motor, a primary control system adapted to monitor the hydraulic pressure in the hydraulic drive system for the hydraulic motor and to regulate the displacement of the pump so as to maintain a predetermined relationship between conveyor speed and the pressure in the hydraulic drive and hence between the conveyor speed and the conveying torque, and a secondary control system which includes control valve means having a control slide, restriction means disposed in one of the hydraulic lines connected to said motor, and power cylinder means for controlling the opening state of said feed valve, said power cylinder means having a differential piston, said control valve means being coupled to said one of the hydraulic lines such that the position of said control slide of said control valve means is determined by the pressure drop across said restriction means and said control valve means being coupled to said power cylinder means to control the variation of the supply of pressurised fluid to said differential piston of said power cylinder means for controlling the opening state of said feed valve.

* * * * *

UNITED STATES PATENT AND TRADEMARK OFFICE

CERTIFICATE OF CORRECTION

PATENT NO. : 4,228,949

DATED : October 21, 1980

INVENTOR(S) : JOSEPH F. JACKSON

It is certified that error appears in the above—identified patent and that said Letters Patent is hereby corrected as shown below:

On the cover sheet, in the heading, delete the following:

[73] Assignee: Thomas Broadbent & Sons Limited, Huddersfield, England

Signed and Sealed this

Seventh Day of April 1981

[SEAL]

Attest:

RENE D. TEGTMEYER

Attesting Officer

Acting Commissioner of Patents and Trademarks